US005490532A

United States Patent [19]

Mallookis et al.

[11] Patent Number: 5,490,532

[45] Date of Patent: Feb. 13, 1996

[54] ADJUSTABLE TENSION SHELTER ASSEMBLY

[75] Inventors: Steven E. Mallookis, Littleton; Albert W. Gebhard, Denver, both of Colo.

[73] Assignee: Colorado Mineral Strike, Inc., Englewood, Colo.

[21] Appl. No.: 272,015

[22] Filed: Jul. 8, 1994

[51] Int. Cl.[6] ..... E04H 15/26

[52] U.S. Cl. ..... 135/117; 135/114; 135/115; 135/99; 135/123; 135/142; 135/157; 135/158; 52/109; 52/222; 160/188; 248/405

[58] Field of Search ..... 52/109, 222, 63, 52/263; 135/114, 115, 117, 97, 99, 121, 122, 123, 142, 143, 144, 157, 158, 908, 907; 160/188; 248/405, 406.1

[56] References Cited

U.S. PATENT DOCUMENTS

| | | | |
|---|---|---|---|
| 3,707,930 | 1/1973 | Yindra et al. | 248/406.1 X |
| 3,810,481 | 5/1974 | Nohmura | 135/158 |
| 4,607,656 | 8/1986 | Carter . | |
| 4,641,676 | 2/1987 | Lynch | 135/115 X |
| 4,890,634 | 1/1990 | Dalo et al. | 135/121 X |
| 4,947,884 | 8/1990 | Lynch | 135/97 |
| 5,000,211 | 3/1991 | Speare et al. | 135/114 X |
| 5,035,253 | 7/1991 | Bortles | 135/122 X |
| 5,135,018 | 8/1992 | Anderson | 135/114 X |
| 5,234,011 | 8/1993 | Lynch | 135/114 X |
| 5,274,980 | 1/1994 | Zeigler | 135/123 X |
| 5,275,188 | 1/1994 | Tsai . | |
| 5,278,188 | 1/1994 | Tsai | 52/109 X |

*Primary Examiner*—Wynn E. Wood
*Attorney, Agent, or Firm*—John E. Reilly

[57] ABSTRACT

A collapsible shelter of the type having an awning and collapsible frame, the frame having either adjustable or fixed end caps at its corners bearing against reinforcing strips, and a center post unit forming a part of the frame is both spring-loaded and can be adjustably tensioned to regulate the tautness of the awning.

15 Claims, 3 Drawing Sheets

ADJUSTABLE TENSION SHELTER ASSEMBLY

BACKGROUND AND FIELD OF INVENTION

This invention relates to collapsible shelters; and more particularly relates to a novel and improved shelter which can be adjustably tensioned at its peak and corner sections so as to be more durable and highly dependable in use.

Collapsible shelters of the type having an awning with corner legs and center peak assemblies are in widespread use for trade shows, exhibits, lawn parties and the like. Typically, the shelters can be constructed in various sizes according to the area and height to be covered and are generally characterized by having an upper canvas awning with scissor-like truss sections between the legs and center peak so that the shelters can be easily erected and collapsed into a compact unit which can either be stored or transported from place to place. A problem often confronting users of such shelters is the wear and tear on the awnings particularly under inclement weather conditions; and, unless the awning structure is maintained in a taut condition, even the heaviest gauge canvas awnings will either tend to separate, rip or tear if subjected to windy conditions or heavy loads over any length of time. For example, in U.S. Pat. No. 4,607,656 to Carter a collapsible shelter of the type described employs a canvas awning with side panels which are seamed together at outside corners or legs of the structure and relies on the use of bolts to fasten the side panels to the truss sections of the shelter to avoid separation between the awning and supporting structure. U.S. Pat. No. 4,641,676 to Lynch employs a similar type of canopy structure to that of Carter and also requires a positive means of attachment between the side panels and legs of the support structure to prevent separation therebetween. U.S. Pat. No. 5,275,188 to Tsai similarly provides for the use of studs and wing nuts to secure the awning to the supporting structure. Moreover, the foregoing and other patents propose the use of spring-loaded center post assemblies, or "peak extenders" which will cause an upper portion of the post assembly to be yieldingly urged against the center point of the awning to increase the tautness or tension on the awning but afford no effective way of adjusting for the tautness of the awning over any appreciable range or to reinforce the awning at critical pressure and wear points.

It is proposed in accordance with the present invention to provide for a novel and improved adjustable tension shelter which obviates the use of fastening elements which must extend through openings or grommets in the awning but instead to reinforce or frictionally engage the awning at the critical points most subject to tearing or flapping under heavywind conditions; and still further to provide for a novel and improved means for adjustably tensioning the awning to the point of optimum tautness and which tension can be easily adjusted each time that the shelter is erected so as to compensate for any change in dimensioning or tolerance between the awning and its supporting structure, for example, as a result of repeated use or wear.

SUMMARY OF INVENTION

It is therefore an object of the present invention to provide for a novel and improved collapsible shelter which is durable and highly efficient in use.

Another object of the present invention is to provide in a collapsible shelter for adjustable tensioning means which will maintain the cover of the shelter in a taut condition when in use and avoid the necessity of close tolerances between the cover and supporting structure.

It is a further object to provide in a collapsible shelter of the type employing a canvas awning for adjustable tensioning elements which will minimize damage and wear of the cover when in use.

It is an additional object of the present invention to provide in a collapsible shelter of the type which employs a canvas cover for reinforcing layers at critical wear points in cooperation with adjustable tensioning means to maintain the cover in a taut condition and which will enable adjustable extension of the peak or center of the cover.

In accordance with the present invention, there is provided in a shelter of the type having an awning, a collapsible frame provided with vertical support legs at spaced peripheral intervals beneath the awning, and a center support extending upwardly from the frame into engagement with an undersurface portion of the awning at its center, the improvement comprising the center support having upper and lower telescoping sleeve members with an upper terminal end of the upper sleeve member engaging the undersurface of the awning, biasing means interposed between the upper and lower sleeve members resiliently urging the upper sleeve member in a direction causing the awning to be raised at its center, and adjustment means engageable with the biasing means for regulating the degree of tension exerted by the biasing means on the upper sleeve and awning. In the preferred form, reinforcing members are affixed to side panels of the awning to engage upper ends of the support legs and resist upward sliding movement of the awning with respect to the frame when tension is applied by the biasing means to the awning. In a modified form of invention, adjustable tensioning members are disposed at upper terminal ends of the the support legs including a bearing member which is urged against the reinforcement members, and means for adjustably tightening the bearing members with respect to the reinforcement members to regulate the tautness of the awning.

The above and other objects of the present invention will become more readily appreciated and understood from a consideration of the following detailed description of preferred and modified forms of the present invention when taken together with the accompanying drawings in which:

DETAILED DESCRIPTION OF PREFERRED EMBODIMENT(S)

Figure 1:
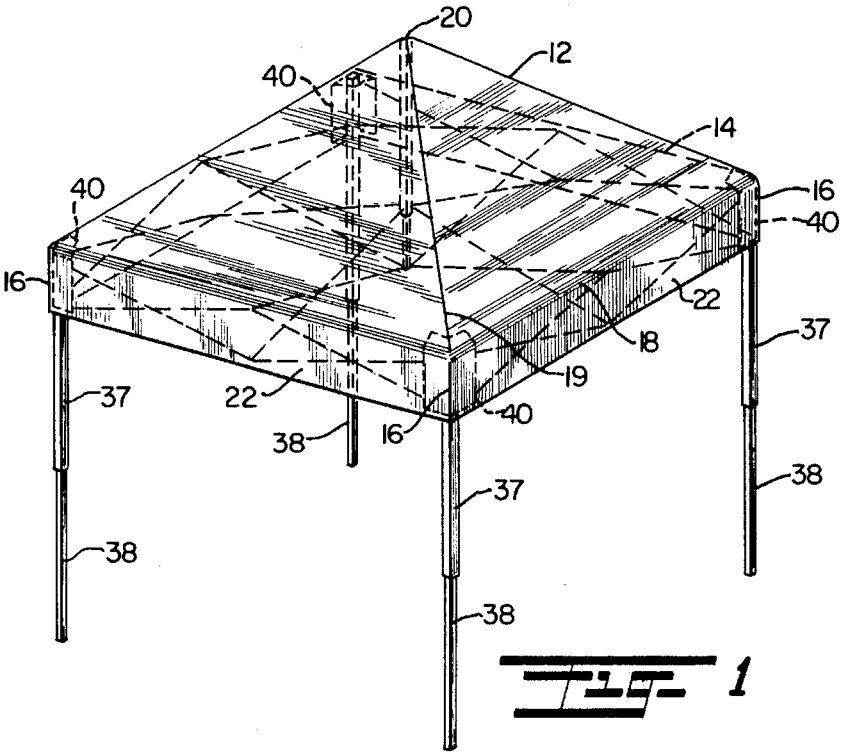
FIG. 1 is a perspective view of a preferred form of collapsible shelter in accordance with the present invention.
Figures 7, 8, 9:
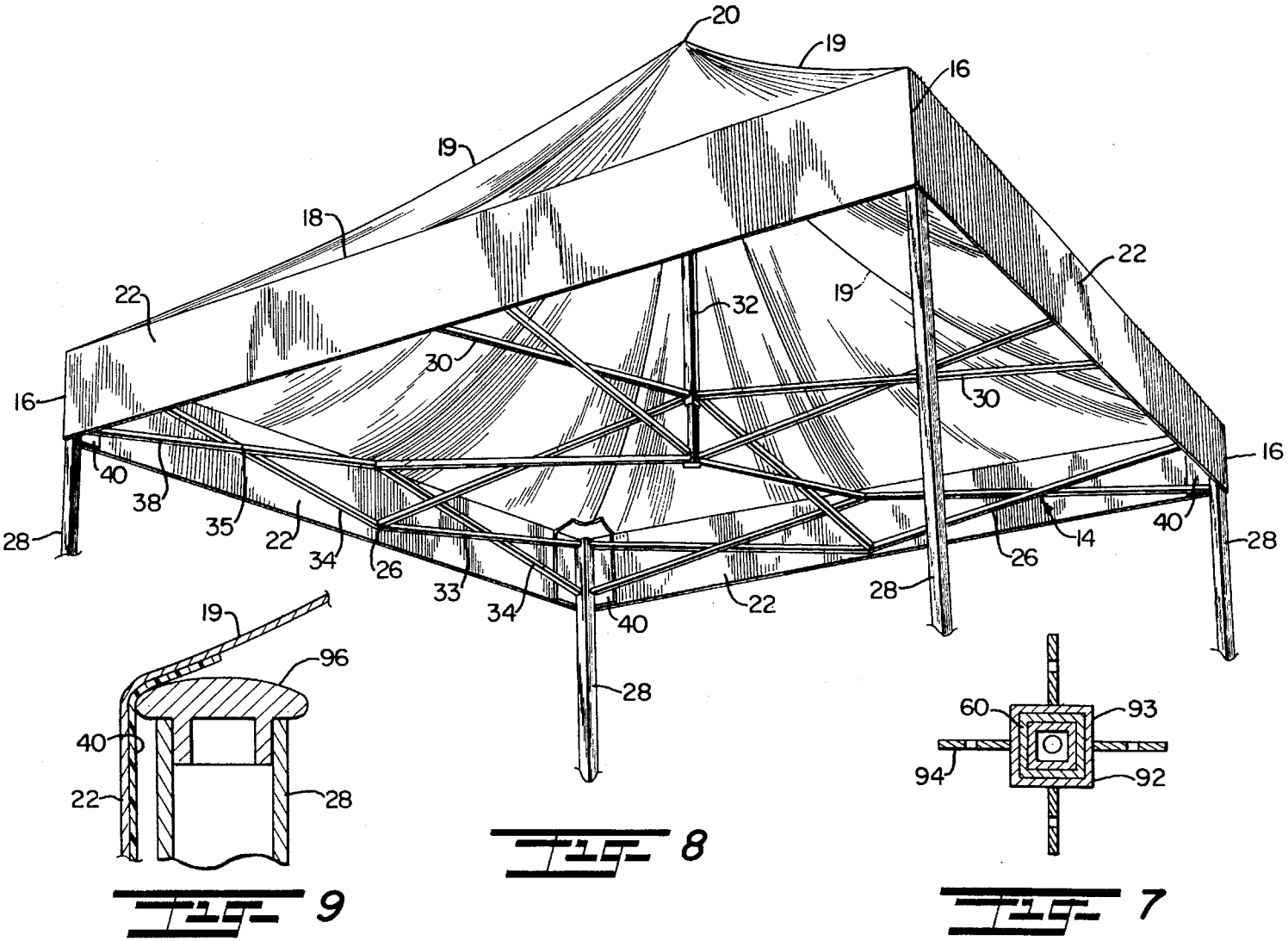
FIG. 7 is a cross-sectional view taken about lines 7—7 of FIG. 5.
FIG. 8 is a perspective view of a modified form of invention taken from a location somewhat beneath the shelter.
FIG. 9 is an enlarged sectional view of a corner leg of the modified form of invention.

Referring in more detail to the drawings, as shown in FIGS. 1 and 8, a preferred form of canopy 10 is broadly comprised of a flexible cover or awning 12 and a collapsible frame assembly 14. By way of illustrative example, the canopy 10 can be made up of an awning or cover 12 of canvas composition and of a generally polygonal configuration with four corners 16. The cover 12 is made up of generally triangular panel sections having outside edges 18 and convergent sides 19 which terminate in an apex or peak 20. The convergent sides 19 are seamed together and extend between the corners 16 and the central peak or apex 20. Side skirts or panels 22 extend downwardly from the four sides 18 of the cover and are joined to the sides as well as along vertical seams at the corner 16.

The frame 14 has outer truss sections 26 which extend along sides of the canopy between upper ends of vertical corner legs 28 so as to be covered by the side skirts 22, and intermediate truss sections 30 extend from midsections of two opposed truss sections 26 to mutually support a center post assembly 32. Each of the truss sections 26 and 30 is comprised of a pair of identical arms or rods 33 and 34 pivoted together at 35. In a conventional manner, uppermost extremities of the arms 33 and 34 are fixed either to the corner legs 28 or the center post assembly 32, as the case may be, and lower extremities are releasably connected to corner legs 28 by sliders 36 which can be released to permit collapse of the canopy into a compact folded condition in a well-known manner. Each corner leg 28 has upper and lower telescoping tubular members 37 and 38 which are of square cross-section and provided with releasable fasteners to regulate the length of extension or height of the canopy in a conventional manner.

Figure 4:
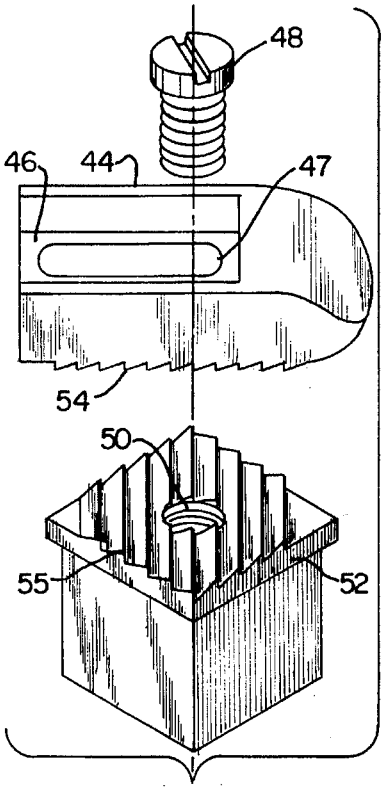
FIG. 4 is an exploded view of a corner leg tensioning element in accordance with the present invention.
Figure 3:
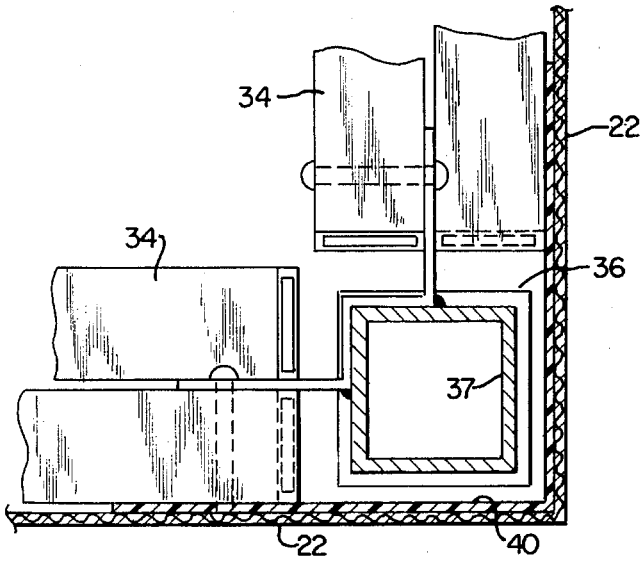
FIG. 3 is a cross-sectional view enlarged through one of the corner leg assemblies of the shelter of the preferred form of invention.
Figure 2:
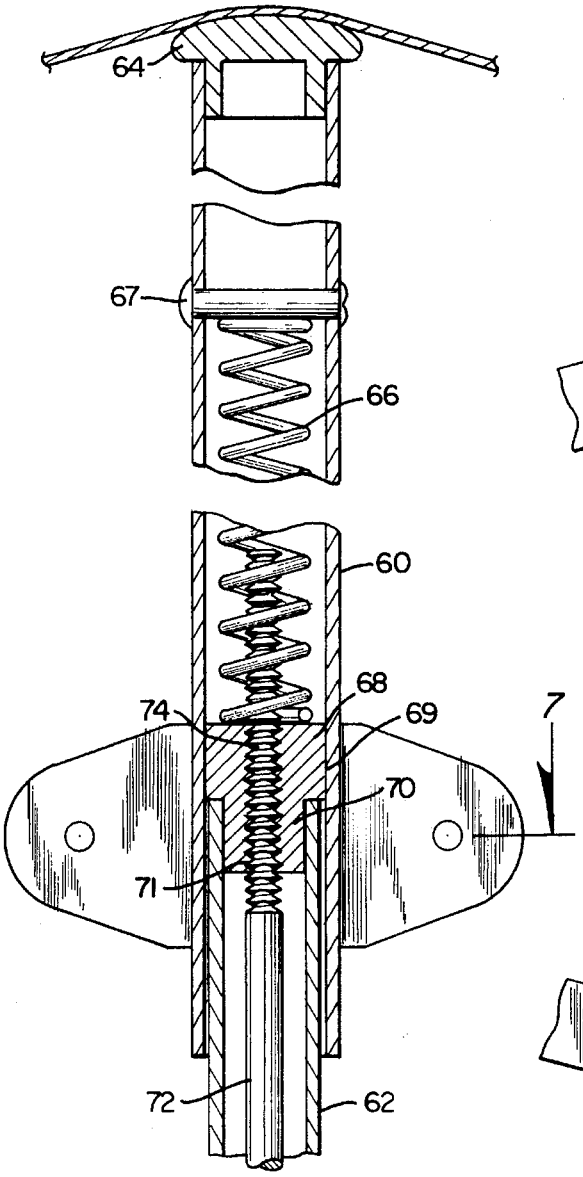
FIG. 2. is a view partially in section and enlarged of a corner leg assembly of the collapsible shelter of the present invention.
Figure 2:
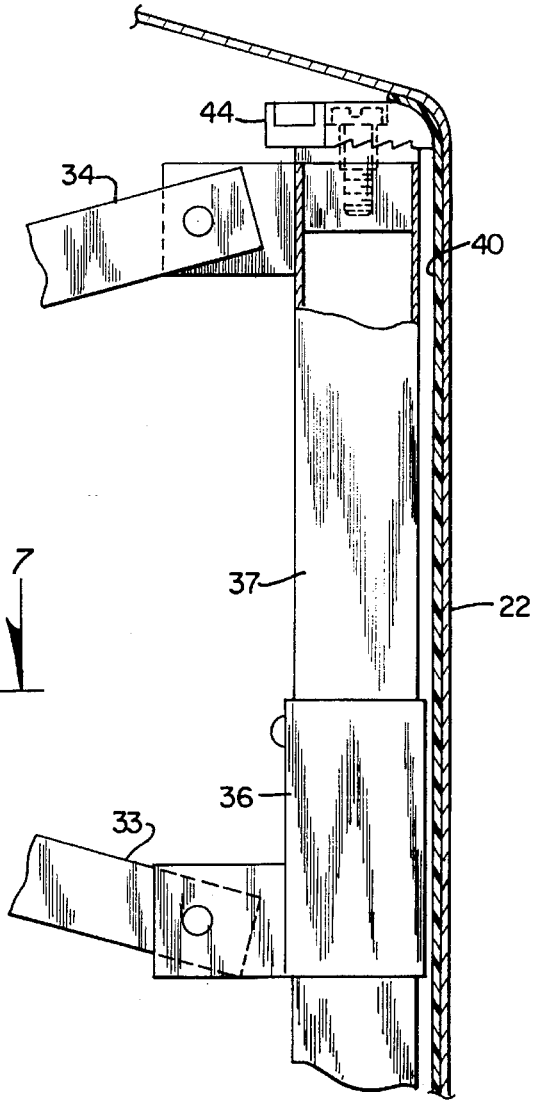

In accordance with the present invention, as best seen from FIGS. 2 to 4, vinyl extrusions in the form of generally rectangular molding strips 40 are bonded or otherwise attached to inner surface portions along the corners of the side panels 22 and specifically at those points where the corner seams of the panels 22 engage the upper ends of the corner legs 28. As shown in FIGS. 2 and 4, each upper terminal end 42 of a corner leg 28 has a bearing member preferably in the form of a bull nose extender 44 mounted thereon. The molding strips 40 are of sufficient stiffness and strength to distribute the pressure of the bull noses 44 against the strips 40 and avoid concentrated pressure on the corner seams. Preferably, each bull nose 44 has a rounded end surface 45 and is adjustably mounted for horizontal extension in a direction toward and away from each respective strip 40. To this end, each bull nose 44 includes a generally channel-shaped, horizontally extending portion 46 with an elongated slot 47 to receive a screw-type fastener 48 which extends downwardly through the slot into threaded engagement with a threaded opening 50 in a rectangular plate 52 affixed to the upper terminal end 42 of each corner leg 16. Ratchet teeth 54 are disposed on the undersurface of the bull nose 44 and are complementary to ratchet teeth 55 on the upper surface of the plate 52, the teeth 54 and 55 being angled in a direction facing the side panels 22 of the cover 12. In this way, the bull nose 44 can be loosened slightly and advanced in a direction increasing its pressure against the strip 40 but the ratchet teeth 54 and 55 will resist inward sliding movement of the bull nose 44 once tightened in place.

A preferred form of center post assembly 32 is illustrated in FIGS. 5 to 8 and includes upper and lower, outer and inner telescoping tubular members or sleeves 60 and 62, respectively. The tubular members 60 and 62 are of generally rectangular or square cross-section, and the upper tubular member 60 has an end cap 64 at its upper terminal end which engages the undersurface of the cover 12 at its center. A coiled spring member 66 is mounted under compression between an upper stationary limit stop 67 and a lower slidable limit stop 68. The lower limit stop 68 is in the form of a square nut which snugly engages the inner surface of the upper sleeve 60. The square nut 68 has an enlarged head 69 which is captured within the upper sleeve 60 and rests on the upper terminal end of the inner sleeve 62, and a reduced portion 70 extends downwardly from the enlarged head 69 through the inner sleeve 62. The nut is provided with a threaded bore 71 to receive an elongated adjusting rod 72 extending upwardly through the inner sleeve 62, the rod 72 including an upper threaded end 74 which threadedly engages the bore 71 and a lower end 76 which projects beyond the lower end of the sleeve 62. A manual adjustment knob 78 is affixed to the lower end 76 of the rod by a pin member 79, and a washer 80 is interposed between the knob 78 and lower end of the sleeve 62. The rod 72 is centered within the sleeve 62 by a bushing 82 and washer 83 disposed at the lower end of the sleeve 62, and a pin 84 extends transversely across the sleeve 62 thereby retaining the bushing 82 and washer 83 at the lower end of the sleeve in seated relation to the washer 80.

Figure 5:
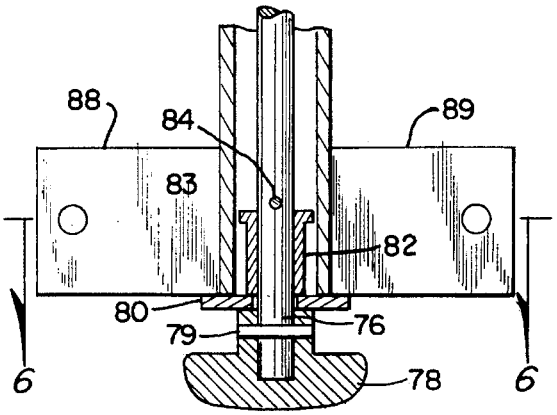
FIG. 5 is a sectional view enlarged of a center post assembly forming a part of the preferred form of invention.
Figure 6:
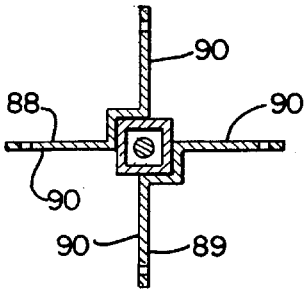
FIG. 6 is a cross-sectional view taken about lines 6—6 of FIG. 5.

The corner post assembly 32 is mounted between adjoining ends of intermediate truss sections 26 by securing lower adjoining ends of arm members 34 to a pair of angular brackets 88 and 89 which are permanently attached to diagonally opposite corners of the lower sleeve 62 as illustrated in FIGS. 5 and 6. Thus, each bracket 88 and 89 has arm portions 90 extending at right angles to one another for attachment of the lower ends of the rod members 33 of the four intermediate truss sections 30. As shown in FIGS. 5 and 7, a sliding bracket 92 includes a square tubular portion 93 disposed in outer surrounding relation to the upper sleeve 60 and arm members 94 at 90° intervals around the portion 93 which extend outwardly for attachment to the upper ends of the rods 34 of the intermediate truss sections 30. Any suitable type of connecting elements, such as, rivets or bolts may be employed between the brackets 88 and 92 and the inner ends of the rods 33 and 34 so that the rod members 33 and 34 are free to pivot with respect to the bracket members 88 and 92.

It will be evident that rotation of the knob 78 and attached rod 72 will cause lengthwise movement of the nut 68 toward and away from the fixed limit stop 67 in the upper sleeve 60 in order to vary the compression of the spring 66 and the upward pressure exerted by the spring via the limit stop 67 and sleeve 60 against the undersurface of the awning 12. Accordingly, as spring tension increases, the degree of tautness of the awning is correspondingly increased to draw the side panels 22 more tightly against the corner legs 28, and the upper sleeve 60 is free to slide upwardly both in relation to the lower sleeve 62 and the mounting bracket 92.

In the embodiment illustrated in FIGS. 8 and 9, like elements to FIGS. 1 to 7 are correspondingly enumerated and the structure illustrated is identical to that of FIGS. 1 to 7 with the exception of the upper terminal ends 42 of the legs 28. In FIGS. 8 and 9, each upper terminal end of a leg 28 is provided with a stationary end cap 96 which bears against a reinforcing strip 40 in place of each adjustable bull nose 44 so that the entire adjustment in tautness of the awning is controlled by the corner post assembly 32.

In practice, the canopy 10 of either preferred form of FIGS. 1 to 7 is erected and collapsed in a conventional manner, essentially by releasing the locking pins on the corner leg slide members 36 of the truss sections. When the bull nose extenders 44 are employed as in FIGS. 1 to 7, each extender may be adjusted either prior to or after erection of the canopy; and of course any individual adjustment required at each corner to remove any slack or wrinkling in the canopy may be made using standard tools to slightly loosen the extender 44 and force it either in an inward or outward direction in relation to the side panels. Similarly, the corner post assembly can be adjusted after erection of the canopy structure 10 by rotation of the knob 78 whereby to increase or decrease the overall tautness of the canopy 12. Although the preferred and modified forms of invention have been described specifically in relation to the use of a canvas awning, it will be apparent that the adjustable tensioning elements are readily adaptable for use with other types of covers and are readily adaptable for use with stationary as well as collapsible frame or truss sections. For example, the cover could be composed of other natural or synthetic fabrics either of stretchable or non-stretchable material. Furthermore, the degree of extension of the center post assembly is such that the nut 68 is free to slide upwardly away from the lower sleeve 62 until it reaches the upper extremity of the threaded portion 74 of the rod 72. As a practical matter, however, the effective length of movement and specifically length of the rod 72 may be varied in accordance with the size of the shelter 10 and characteristics of the material which comprise the awning 12.

It is therefore to be understood that while preferred forms of the invention are herein set forth and described, various modifications and changes may be made in the construction and arrangement of parts as well as composition of elements without departing from the spirit and scope of the present invention as defined by the appended claims and reasonable equivalents thereof.

We claim:

1. In a shelter of the type having an awning and a collapsible frame having vertical support legs at spaced peripheral intervals beneath said awning, and a center support extending upwardly from said frame into engagement with an undersurface portion of said awning at its center, the improvement comprising:

said center support including upper and lower telescoping sleeve members with an upper terminal end of said upper sleeve member engaging the undersurface of said awning, biasing means defined by a spring member mounted under compression between said upper and lower sleeve members resiliently urging said upper sleeve member in a direction causing said awning to be raised at its center, and adjustment means engaging said biasing means for regulating the degree of tension exerted by said biasing means on said upper sleeve and awning, said adjustment means including a nut slidable axially with respect to said upper and lower sleeve members and a manually adjustable threaded rod extending upwardly from a lower end of said lower sleeve into threaded engagement with said nut.

2. In a shelter according to claim 1, including resistance means between said frame and said awning for resisting upward sliding movement of said awning with respect to said frame when tension is applied by said biasing means to said awning.

3. In a shelter according to claim 2, wherein said awning includes side panels disposed externally of upper terminal ends of said legs, said resistance means being interposed between said legs and said side panels.

4. In a shelter according to claim 3, said resistance means including reinforcing strips affixed to said side panels, said reinforcing strips being interposed between said side panels and said legs.

5. In a shelter according to claim 1, wherein said adjustment means includes a manual adjustment knob at a lower end of said rod.

6. In a shelter according to claim 1, wherein said upper and lower sleeves are of generally rectangular cross-section and said upper sleeve is disposed in outer surrounding relation to said lower sleeve.

7. In a collapsible shelter wherein an awning is surmounted on a collapsible frame, said frame having vertical support legs at corners of said awning and a center support extending upwardly from said frame into engagement with an undersurface of said awning, the improvement comprising:

corner reinforcement strips interposed between said awning and said support legs; and said center support including upper and lower telescoping sleeve members with an upper terminal end of said upper sleeve member engaging said undersurface of said awning, biasing means including a spring mounted under compression between said upper and lower sleeve members for resiliently urging said upper sleeve member in a direction causing said awning to be raised at its center with respect to said corners, and threaded adjustment means engaging said biasing means for regulating the tension exerted by said biasing means on said upper sleeve and awning as well as the tension between said reinforcement strips and said support legs, said threaded adjustment means including a nut slidable axially with respect to said upper and lower sleeve members and a manually adjustable threaded rod extending upwardly from a lower end of said lower sleeve into threaded engagement with said nut.

8. In a collapsible shelter according to claim 7, wherein said awning includes side panels disposed externally of upper terminal ends of said support legs, said reinforcement strips being interposed between said side panels and said support legs.

9. In a collapsible shelter according to claim 8, wherein said reinforcement strips are defined by molding strips of a plastic or plastic-like material having high frictional resistance.

10. In a collapsible shelter according to claim 9, said molding strips being in the form of vinyl extrusions.

11. In a collapsible shelter of the type having an awning and a collapsible frame with vertical support legs at spaced intervals around an outer peripheral edge of said awning and a center support extending upwardly from said frame into engagement with an undersurface portion of said awning, the improvement comprising:

flexible reinforcement members interposed between upper ends of said support legs and said awning; and adjustable tensioning means at upper terminal ends of said support legs including a bearing member and means for urging said bearing member against said reinforcement members.

12. In a collapsible shelter according to claim 11, said bearing members each including a bull nose, and said tensioning means including an end cap at an upper end of each said support leg with complementary ratchet teeth between said end cap and said bull nose, and means for adjustably tightening said bull nose with respect to said end cap.

13. In a collapsible shelter according to claim 11, wherein said awning includes side panels disposed externally of upper terminal ends of said support legs, said reinforcement members being interposed between said side panels and said support legs.

14. In a collapsible shelter according to claim 13, wherein said reinforcement members are defined by molding strips of a plastic or plastic-like material having high frictional resistance.

15. In a collapsible shelter according to claim 14, said molding strips being in the form of vinyl extrusions.

* * * * *